United States Patent [19]

Tyrseck

[11] 3,968,924

[45] July 13, 1976

[54] BULB CARTON

[75] Inventor: Walter J. Tyrseck, Quaker Hill, Conn.

[73] Assignee: Robertson Paper Box Co., Inc., Montville, Conn.

[22] Filed: July 28, 1975

[21] Appl. No.: 599,389

[52] U.S. Cl. ..... 229/39 B; 206/418
[51] Int. Cl.[2] ..... B65D 85/42
[58] Field of Search ..... 206/68, 918, 45.14; 229/39 B, 42

[56] References Cited

UNITED STATES PATENTS

| | | | |
|---|---|---|---|
| 2,870,949 | 1/1959 | Currivan | 229/39 B |
| 3,182,885 | 5/1965 | Maio | 206/418 |
| 3,384,223 | 5/1968 | Manizza | 229/39 B |
| 3,547,256 | 12/1970 | Bolding | 206/418 |
| 3,820,707 | 6/1974 | Fischer et al. | 229/39 B |

*Primary Examiner*—George E. Lowrance
*Assistant Examiner*—Bruce H. Bernstein
*Attorney, Agent, or Firm*—Cesari and McKenna

[57] ABSTRACT

A generally rectangular carton for protectively enclosing a light bulb, or other fragile article including apertured partitions spaced from opposite sides of the carton for receiving and retaining the opposite sides of the bulb. Flaps adjacent the apertures extending between the sides of the bulb and the sides of the carton help to protect the bulb and to retain it in the carton.

4 Claims, 18 Drawing Figures

BULB CARTON

BACKGROUND OF THE INVENTION

This invention relates to a carton for protectively enclosing a light bulb, globe or other fragile article. It relates more particularly to a carton of this type made from a single blank of material which may be stored in a flattened condition when not in use.

Light bulbs are normally shipped and stored in generally rectangular protective enclosures. These may simply be open ended, corrugated cardboard sleeves or more elaborate cartons having interior partitions and tabs which isolate the bulb from the outside walls of the carton so that the bulb is protected and buffered from shocks encountered during normal handling. Examples of such cartons are illustrated in U.S. Pats. Nos. 2,870,949 and Re. 23,670.

Prior cartons and boxes of this general type are disadvantaged because they do not adequately protect all areas of the bulb. For example, in the carton shown in the former patent identified above, various apertures must be formed in the carton in order to create interior panels to protect the contents. These apertures provide access into the carton for dirt and grit which can mar the surface of the contents. Also, elongated objects such as sticks, rods and wire can project into these apertures and actually destroy the contents.

Other cartons such as those represented in both of the above patents have interior panels or flaps which protect less than all sides of the article in the carton. In other words, one or more sides of the articles may be in direct contact with one or more walls of the carton so that if the carton is dropped or struck at those locations, the force is transmitted directly to the articles.

Other cartons of this general type use an excessive amount of material or require several folding and glueing operations to form the finished carton. Therefore they are relatively expensive to make.

SUMMARY OF THE INVENTION

Accordingly, the present invention aims to provide a carton for a light bulb or other fragile article which gives a maximum amount of protection to the carton contents.

A further object of the invention is to provide a carton for a bulb or other fragile article which requires a minimum amount of material.

Still another object is to provide a carton of this general type which is made from a single cardboard blank with a minimum number of folding and glueing steps.

A further object of this invention is to provide a light bulb carton which isolates all sides of the bulb from the walls of the carton.

Other objects will in part be obvious and will in part appear hereinafter.

The invention accordingly comprises the features of construction, combination of elements and arrangement of parts which will be exemplified in the constructions hereinafter set forth, and the scope of the invention will be indicated in the claims.

Briefly, the subject carton has four, generally rectangular outer walls hinged together to form an open-ended tube. A generally U-shaped panel structure is centered inside the tube at one end. The legs of the U-shaped structure comprise two parallel partitions spaced from one pair of opposite carton sidewalls. The ends of the legs of the panel structure as well as its bridge portion are secured to the other pair of opposite carton sidewalls.

Flaps are formed in the partitions which, in one embodiment, splay outward and in a second embodiment, fold inward to form apertures in the partitions for receiving and retaining the bulbous portion of a light bulb inserted through an open end of the carton. These flaps further function to isolate the bulb from the sidewalls of the carton so that the bulb is buffered from impacts against the carton.

BRIEF DESCRIPTION OF THE DRAWINGS

For a fuller understanding of the nature and objects of the invention, reference should be had to the following detailed description taken in connection with the accompanying drawings, in which.

DESCRIPTION OF THE PREFERRED EMBODIMENTS

Figure 1:
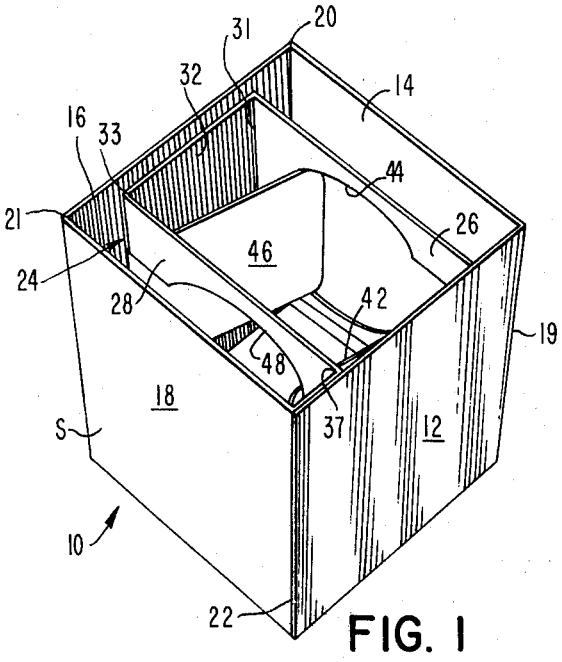
FIG. 1 is a perspective view showing a carton for a bulb or other fragile article made in accordance with this invention.

Referring to FIGS. 1 to 4 in the drawings, the subject carton indicated generally at 10 comprises four rectangular wall panels 12, 14, 16 and 18 hinged together at hinge lines 19, 20, 21 and 22, respectively, to form an open-ended tube.

Figure 4:
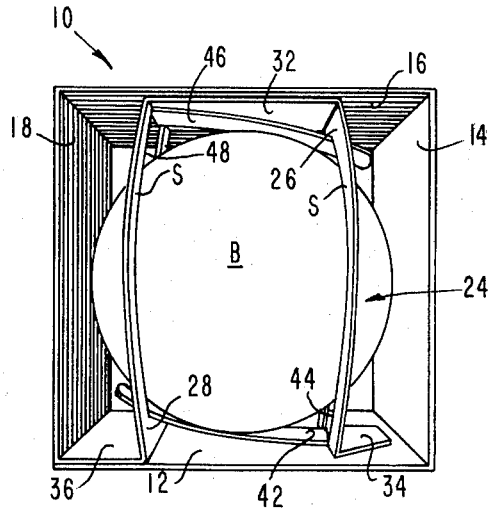
FIG. 4 is a top view of the carton containing a bulb.

A U-shaped partition structure shown generally at 24 is centered inside the carton at one end thereof. As shown in FIG. 4 structure 24 supports a bulb indicated at B within carton 10. Structure 24 also protectively isolates bulb B from the outside wall panels of the carton so that in the event the carton is dropped or struck from without, that force is not transmitted to the bulb inside the carton.

As will be seen presently, carton 10 is made from a single carboard blank with a minimum number of folding and glueing operations. Furthermore, the carton may be flattened when not in use so that it can be shipped and stored in a minimum amount of space, thus minimizing handling costs.

Still referring to FIGS. 1 to 4, the legs of the U-shaped structure 24 comprise a pair of parallel partition panels 26 and 28 spaced inwardly from carton wall panels 14 and 18 respectively. Corresponding ends of the panels 26 and 28 are hinged at 31 and 33 respectively to a bridging panel 32 which is secured to carton wall panel 16. The opposite ends of panels 26 and 28 are hinged at 35 and 37 respectively to glue flaps 34 and 36 secured to carton wall panel 12.

Figure 2:
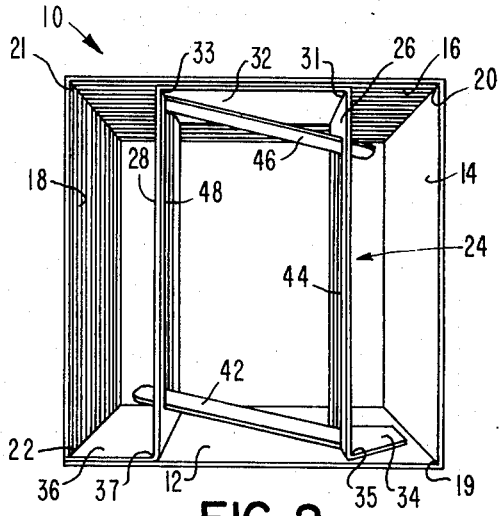
FIG. 2 is a top view thereof.
Figure 3:
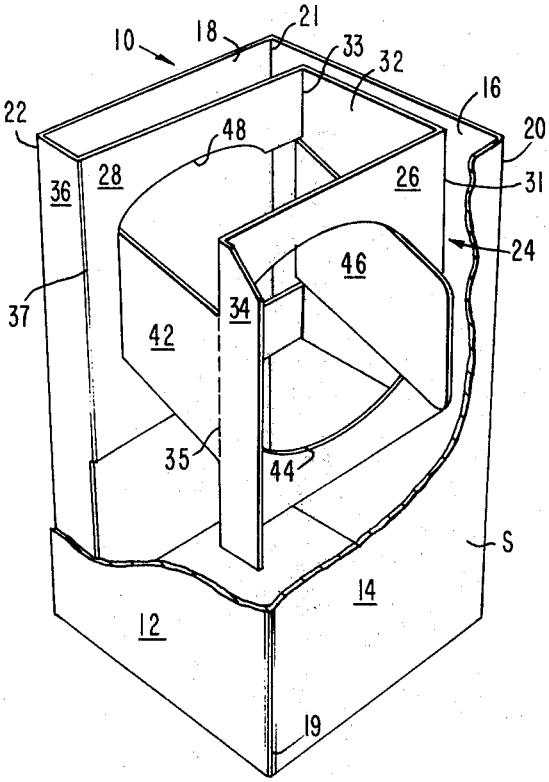
FIG. 3 is another perspective view of the carton with parts cut away.

As best seen in FIGS. 2 to 4, a generally rectangular lateral tongue 42 is formed in panel 26 and is hinged at 35 to glue flap 34 leaving an opening 44 in panel 26. Actually, the panel 26 is preferably cut so that the opening 44 is appreciably larger than tongue 42 so that it will receive and retain the widest portion of bulb B. A similar tongue 46 is cut in partition panel 28 so that it is hinged at 33 to bridging panel 32 leaving an oversized opening 48 to accommodate the opposite side of bulb B. Tongue 42 formed from partition panel 26 projects through opening 48 in partition panel 28. Similarly, tongue 46 formed from partition panel 28 projects through opening 44 in partition panel 26. Accordingly the tongue ends are spaced from the carton wall panels 12 and 16 and thus isolate bulb B from those wall panels, while the partition panels 26 and 28 isolate the bulb from the outside carton wall panels 14 and 18. Consequently no part of the bulb is in direct contact with an outside wall panel so that the bulb is well isolated and buffered from impact forces on the carton.

Bulb B can be inserted into carton 10 from either end. The bulb displaces the partition panels 26 and 28 outward until its bulbous portion snaps into the opening 44 and 48 whereupon the partition panels resume their original unstressed shape so that the bulb is resiliently retained between those partition panels. Accordingly, even though the carton is dropped on end, the bulb which is recessed into the carton ends does not become dislodged from openings 44 and 48.

Of course, if desired, the carton may be provided with conventional cover panels at one or both ends to completely enclose the bulb.

FIGS. 5 to 9 illustrate the cardboard blank from which the FIG. 1 carton is made and the various folding and glueing operations involved in forming the carton. The panel flaps and hinge lines carry the same identifying numerals assigned to the corresponding elements in FIG. 1.

Figure 5:
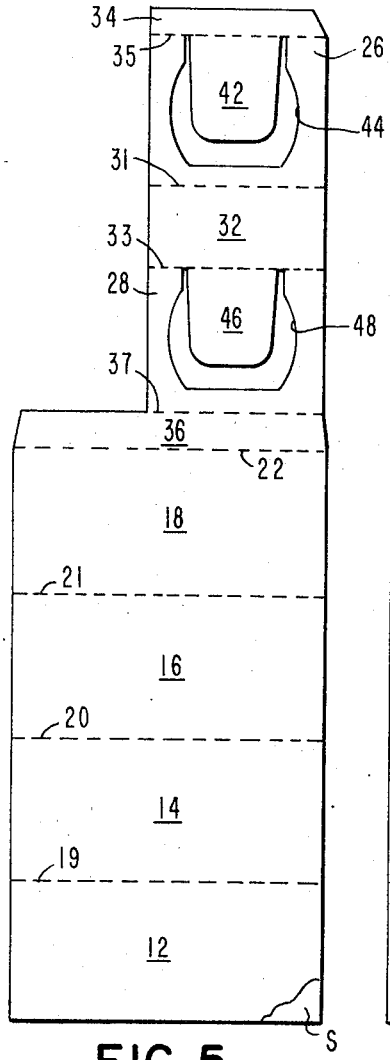
FIG. 5 is a top plan view of the blank from which the FIG. 1 carton is made.
Figure 6:
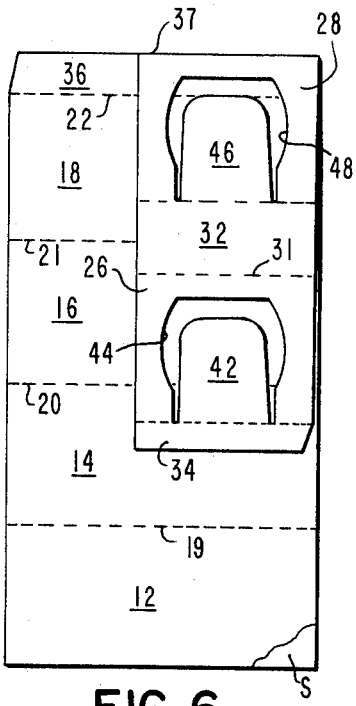
FIG. 6–9 are similar views showing the successive folds made in the FIG. 5 blank to form the carton.
Figure 7:
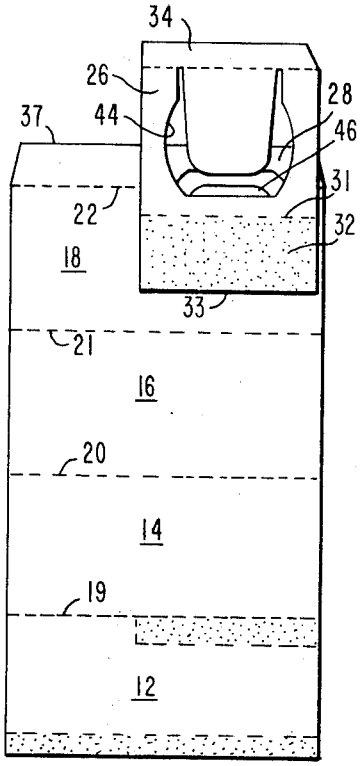
Figure 8:
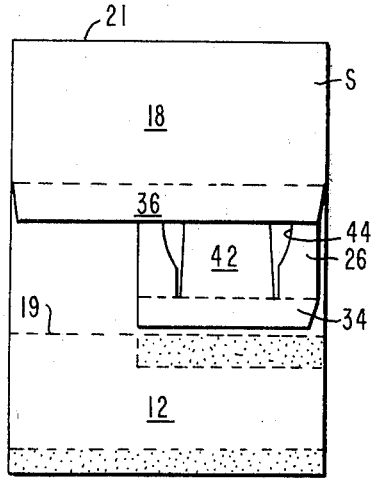
Figure 9:
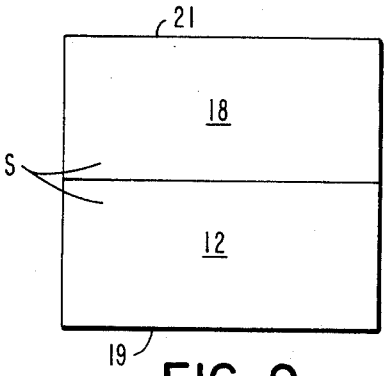

Preferably the undersurface of the FIG. 5 blank is provided with a finished calendered paper surface S which may be white or colored so that when the blank is folded as shown, the carton 10 has a finished exterior.

The blank is first folded at hinge line 37 so that panels 26 and 28 overlie panels 16 and 18, respectively. Next the blank is reverse-folded at hinge line 33 and glue is applied to the three locations indicated by stippling in FIG. 7. Next the blank is folded at hinge line 21 so that panel 18 overlies panel 16. At this point, the panel 32 becomes adhered to the top of panel 16 and the glue flap 34 overlies the top panel 12. Finally, panel 12 is folded at hinge line 19 and becomes adhered to flaps 34 and 36. The carton is erected simply by pressing together the opposite corners of the folded carton in FIG. 9. Whereupon the bulb B can be inserted into the carton from either end as described above.

Figure 10:
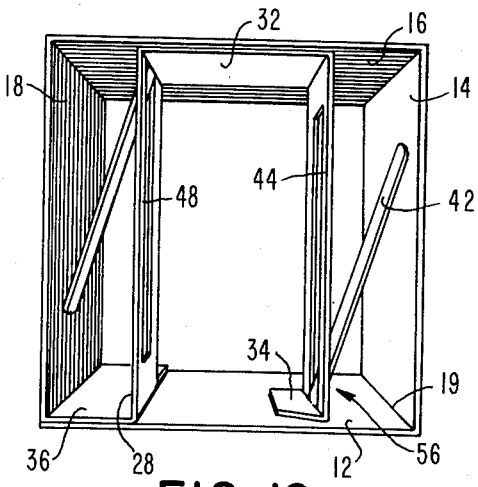
FIG. 10 is a view simlar to FIG. 2 illustrating a modified carton construction.
Figure 11:
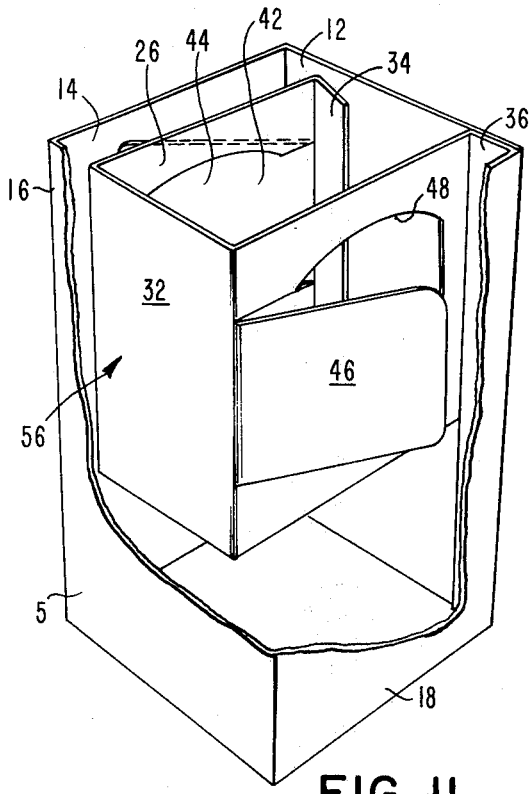
FIGS. 11 and 12 are views similar to FIGS. 3 and 4 thereof.
Figure 12:
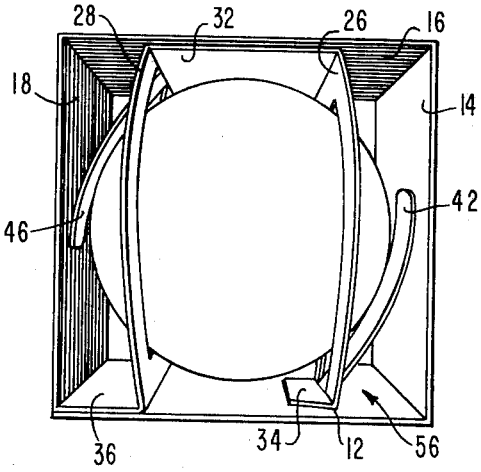

Turning now to FIGS. 10–12, a modified embodiment of the subject carton has an internal partition structure shown generally at 56 which is somewhat different than structure 24 in the FIG. 1 carton. In this case, the tongues 42 and 46 splay outwardly and bear against their adjacent side wall panels 14 and 18, respectively. Thus, the tongues provide double protection for the bulb adjacent the wall panels 14 and 18. On the other hand, the partition structure still spaces the bulb B appreciably from the other side wall panels 12 and 16 so that the bulb is completely protected from impacts on the carton from those directions.

This modified carton can be made from the FIG. 5 blank with only three folds simply by following a different folding procedure. First the blank is folded at hinge line 22, glue having been applied to panel 32. Then it is reverse-folded at hinge line 31. Finally the blank is folded at hinge line 20 so that panels 12 and 14 overlie the reverse-folded panel 26, glue having been applied to flap 31 and panel 12. Now the opposite side of the glue flap 34 is adhered to the carton wall panel 12 so that the tongue 42 is biased outward instead of inward toward the opposite partition, as was the case with the FIG. 1 carton. Similarly, the tongue 46 tends to assume a position against the adjacent carton wall 18 rather than extending toward the partition panel 26 as in the FIG. 1 carton. Otherwise, the various carton panels and flaps are positioned more or less the same as the corresponding panels in the FIG. 1 carton.

Figure 13:
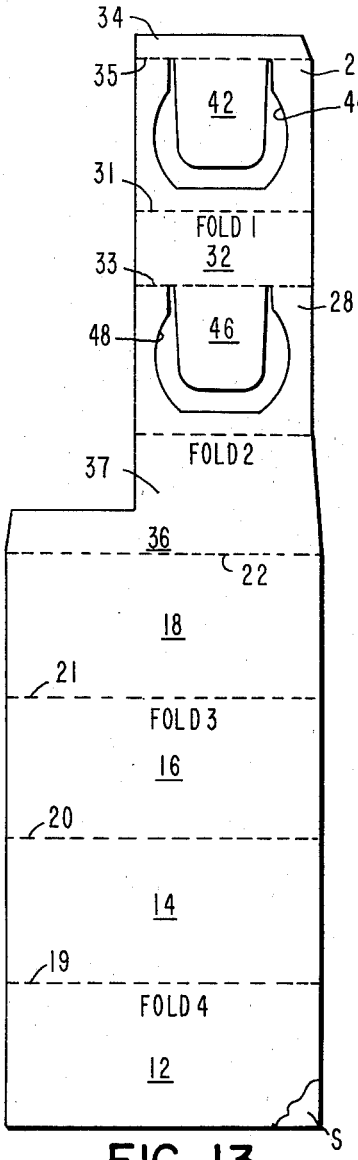
FIGS. 13 to 17 are views similar to FIGS. 5 to 9 showing a modified blank for making a carton similar to the FIG. 10 carton.
Figure 14:
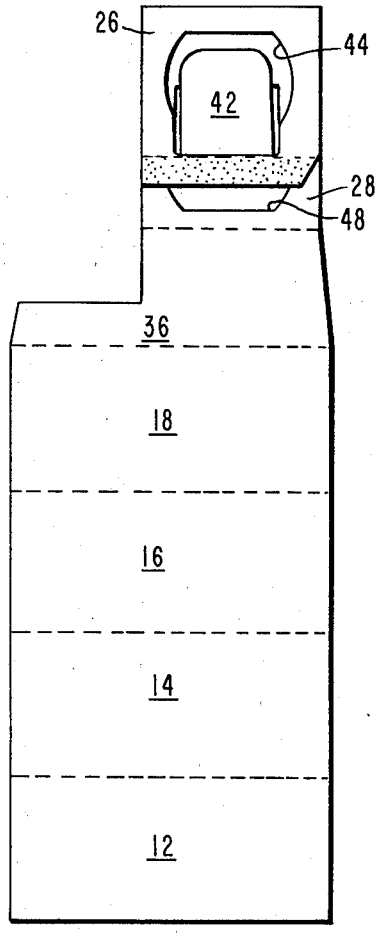
Figure 15:
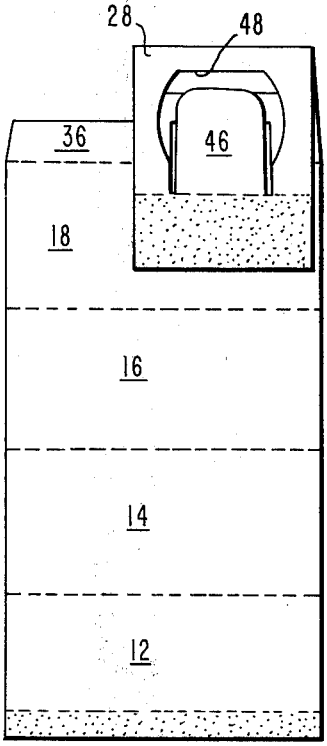
Figure 16:
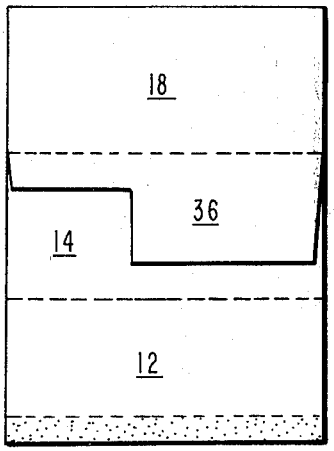
Figure 17:
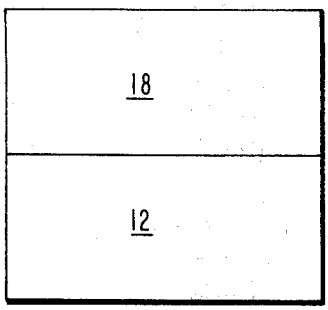

A carton similar to the one in FIG. 10 can also be formed from the blank illustrated in FIGS. 13 and 17. This blank has the advantage of requiring no reverse folds, thereby further simplifying the folding and gluing operations. Glue is applied to the blank as indicated by the stippling and the blank is continuously folded in the same direction beginning at the top except for the final fold in FIG. 17.

Figure 18:
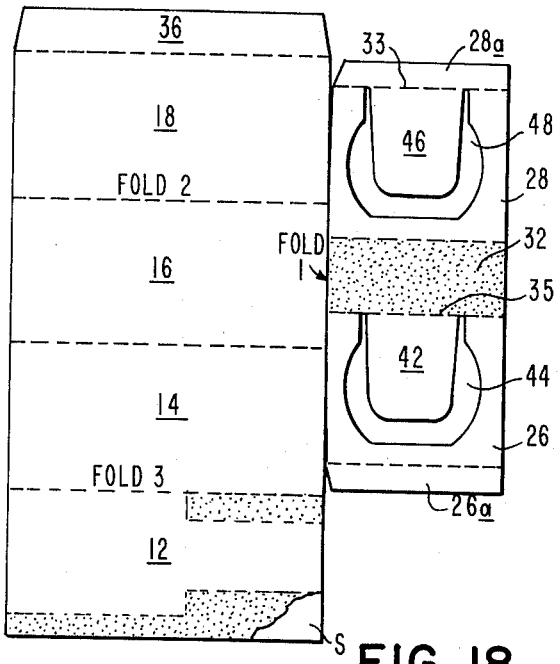
FIG. 18 is a top plan view of another modified blank for forming a carton similar to the one in FIGS. 10 to 12.

FIG. 18 illustrates a modified blank for making a carton similar to the one in FIG. 10. The glue locations are indicated by stippling and the folding order of the panels is also shown. The panel arrangement is similar to that described above except that panel 32 is hinged to panel 16 and panels 26 and 28 have hinged glue flaps 26*a* and 28*a* which are adhered to panel 12 when the blank is folded.

It is also possible to use the same FIG. 18 blank to make a carton with inwardly folding tongues similar to the one in FIG. 1 by gluing and folding the blank differently. Glue is applied to the panels at the locations of the dark strips Panels 26 and 28 are folded onto panels 14 and 18. Then glue flap 36 is folded over onto glue flap 28*a*. Finally the blank is folded at the hinge line between panels 14 and 16 so that panel 12 ahderes to glue flaps 26*a* and 36.

In all of these cartons, the hinge lines or roots of the tongues 42 and 46 are located at a carton wall panel so that there is no tendency for the partition panels to tear as the bulb B is inserted into the carton. In other words, if the tongues were hinged away from the wall panels, the partition panels would tend to tear where the tongues join them, thereby breaking the carton and possibly allowing the bulb B to touch one of the carton wall panels.

Cartons from the FIGS. 5 and 18 blanks are particularly advantaged because, as seen in FIGS. 4 and 12, in the case of the former blank, their partition panel sides facing the bulb also have the finished surface S which is desirable from a marketing standpoint.

As seen from the foregoing, then, the subject carton for light bulbs and other fragile articles isolates its contents from impacts on the carton. The carton is made from a minimum amount of material with a minimum number of folding and glueing steps so that it is relatively inexpensive to make. Of course, it will be obvious that certain changes may be made in the described constructions without departing from the scope of the invention. For example, the carton side wall panels can be made longer, and internal partition structure provided at each end so that the carton can receive and retain two bulbs inserted into it from opposite ends. Also, the sizes of the various panels, tongues and openings can be altered as needed to accomodate bulbous articles of different sizes and shapes such as globes, lamp chimneys, etc.

It will further be seen that the objects set forth above, among those made apparent from the preceding description are efficiently attained and since certain changes may be made in the above constructions without departing from the scope of the invention, it is intended that all matter contained in the above description or shown in the accompanying drawings be interpreted as illustrative and not in a limiting sense.

It is also to be understood that the following claims are intended to cover all of the generic and specific features of the invention herein described.

I claim:

1. A carton for protectively enclosing a bulbous article comprising

A. four wall panels hinged together to form a tube,

B. a generally U-shaped partition structure within the tube, the legs of said partition structure constituting partition panels spaced generally parallel to a first pair of opposite wall panels, C. means for hinging opposite side edges of the bridging portion of the U-shaped partition structure to one panel in the second pair of opposite wall panels, D. means for hinging the free end edges of the legs of the U-shaped structure to the other wall panel in the second pair of opposite wall panels, and E. a single lateral tongue struck from each partition panel leaving an opening in each partition panel, said tongues having their roots at the hinges of said bridging portion and leg respectively to the second pair of wall panels, being longer than the width of the bridging portion, and positioned to extend between the wall panels and an article positioned between the partition panels and received and retained in the openings.

2. The carton defined in claim 1 and further including means for biasing the tongue struck from each partition panel so that the tongue projects through the opening in the other partition panel.

3. The carton defined in claim 1 and further including means for biasing the tongue struck from each partition panel so that the tongue extends between its partition panel and engages the adjacent wall panel a substantial distance across said adjacent wall panel.

4. The carton defined in claim 1 wherein the size of the opening in each partition panel is larger than the size of the tongue struck from that panel.

* * * * *